United States Patent [19]

Benjamin

[11] 4,237,078

[45] Dec. 2, 1980

[54] CARBURETOR CHOKE CONTROL

[75] Inventor: Benjamin C. Benjamin, Flint, Mich.

[73] Assignee: Schmelzer Corporation, Durand, Mich.

[21] Appl. No.: 47,361

[22] Filed: Jun. 11, 1979

[51] Int. Cl.[3] ..... F02M 1/12

[52] U.S. Cl. ..... 261/39 B; 261/39 E; 236/101 C; 236/101 D; 123/588

[58] Field of Search ..... 261/39 B, 39 E; 236/101 C, 101 D; 73/363.9; 123/119 F

[56] References Cited

U.S. PATENT DOCUMENTS

| | | | |
|---|---|---|---|
| 2,143,640 | 1/1939 | Agricola | 236/101 D |
| 2,210,922 | 8/1940 | Joesting | 236/101 D |
| 2,920,876 | 1/1960 | Brown et al. | 261/39 B |
| 3,120,841 | 2/1964 | Boller | 261/39 B |
| 3,210,004 | 10/1965 | Hunt et al. | 236/101 C |
| 3,699,937 | 10/1972 | De Petris | 261/39 B |
| 3,906,912 | 9/1975 | Jackson et al. | 261/39 B |
| 3,947,531 | 3/1976 | Branigin | 261/39 B |
| 3,972,311 | 8/1976 | De Petris | 261/39 E |
| 4,054,620 | 10/1977 | Daigler | 261/39 B |
| 4,081,499 | 3/1978 | Ishii et al. | 261/39 E |

FOREIGN PATENT DOCUMENTS

| | | | |
|---|---|---|---|
| Ad.27730 | 4/1924 | France | 261/39 B |
| 4140 | of 1914 | United Kingdom | 261/39 B |

*Primary Examiner*—Tim R. Miles

*Attorney, Agent, or Firm*—Fisher, Gerhardt, Crampton & Groh

[57] ABSTRACT

A carburetor choke control arrangement incorporating a temperature responsive bimetal coil and a diaphragm actuated vacuum motor supported jointly to operate on the choke valve. The length of stroke of the vacuum motor and adjustment of the bimetal coil are each achieved by a single screw adjustment.

7 Claims, 4 Drawing Figures

2
3
10
12
14
16
18
20
22
26
28
30
32
33
36
38
40
41
42
44
45
46
48
50
52
54
56
60
62
64
66
68
70
76
78
80
82
83
84
86
88
90
92
93
94
98
100

CARBURETOR CHOKE CONTROL

This invention relates to carburetor control assemblies and more particularly to devices controlling the opening and closing of a choke valve.

Many conventional carburetor control arrangements for internal combustion engines incorporate an automatic choke control by which the choke valve of the carburetor is opened as the engine warms up after being started. Such carburetors also often include a vacuum break device which is effective to open the choke valve of the carburetor even though the automatic choke has not yet been conditioned by temperature to do so to avoid flooding of the engine or undesirable exhaust emissions. Such automatic choke control devices and vacuum break devices typically make provision for adjustment and are mounted on the carburetor and are connected to the choke valve through a complex arrangement of linkages and levers which interfere with adjustment. When the automatic choke control is electrically heated to respond to engine or ambient temperatures, the problem of making electrical and mechanical connections and adjustment are further aggravated.

It is an object of the invention to provide a choke control assembly embodying both an automatic choke control and a vacuum break device.

Another object of the invention is to provide a choke control assembly in which mounting and adjustment is greatly simplified.

Still another object of the invention is to provide a choke control assembly wherein an automatic choke device is electrically heated in response to ambient or engine temperature and wherein the electrical connections also are greatly simplified.

The objects of the invention are accomplished by a choke control mechanism for regulating the choke of a carburetor of an internal combustion engine in which a unitary housing contains both a bimetal coil and a vacuum servomotor including a diaphragm arrangement. The bimetal coil has one end anchored on a plate member located in the interior of the housing to rotate to coil or uncoil the bimetal coil to determine the amount of force applied at its outer end. The outer end is connected to the choke of the carburetor through a lever arrangement such that the choke is urged to a closed position when engine is relatively cold and is not operating with a force inversely proportional to engine temperature. The diaphragm means also acts on the choke and is responsive to a source of vacuum created when the engine is started and is operating to move the choke valve from its closed position in opposition to the closing force of the coil. When the engine becomes sufficiently heated, the coil is effective to move the choke valve to its fully open position. The bimetal coil is heated by electric heating means positioned adjacent to the bimetal coil. The heating means are responsive to engine and temperature to accelerate heating of the bimetal coil and opening of the choke. The electric connections to the electric heating means are made through a terminal positioned on the stationary exterior of the housing and the circuit to the heating means is completed through an adjusting arm which protrudes to the exterior of the housing and is clamped to the carburetor in a manner creating a ground completing the circuit.

These and other objects of the invention will be apparent from the following description and from the drawings in which.

Figures 1, 2:
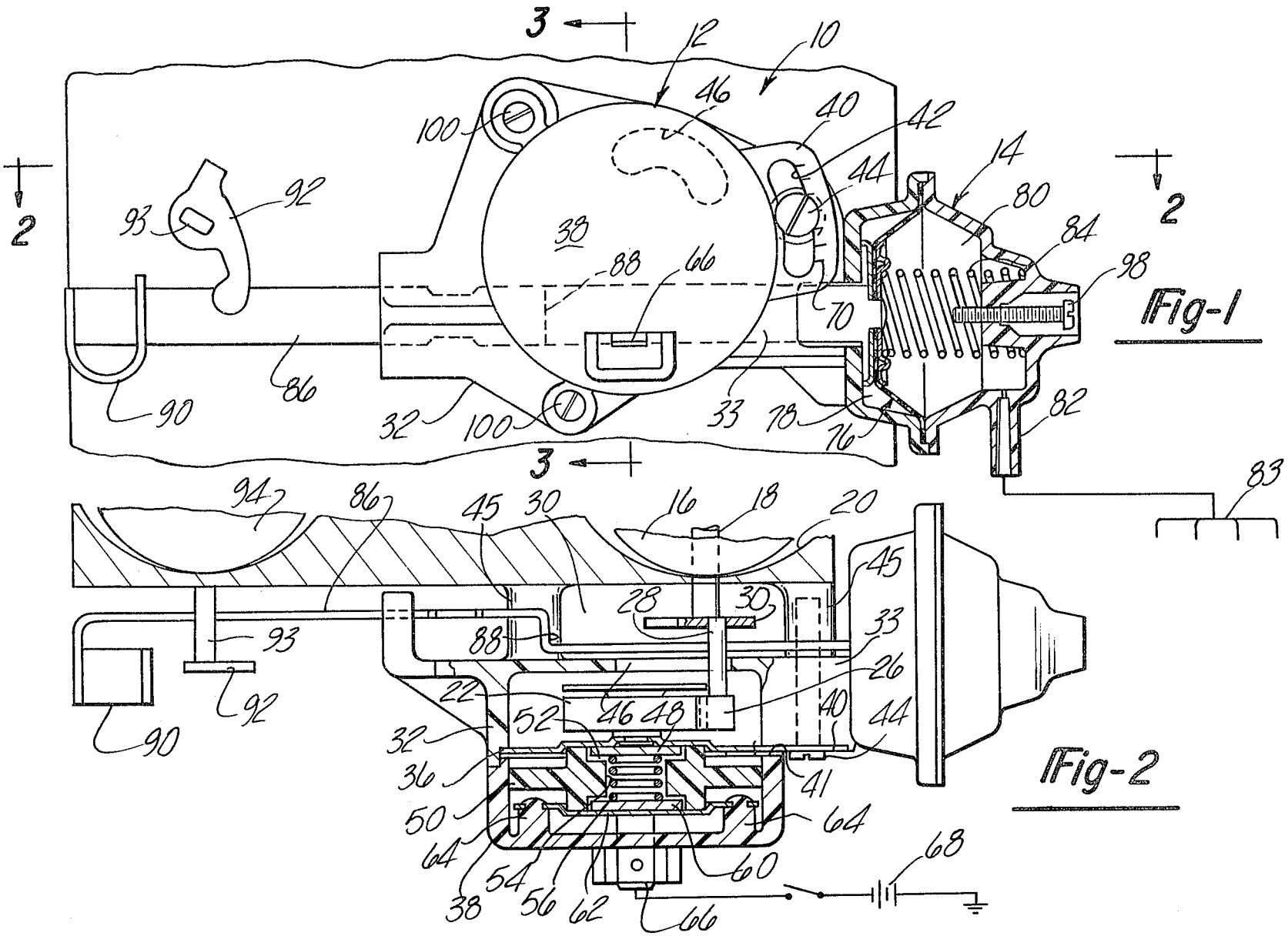
FIG. 1 is a fragmentary side elevation of the choke control assembly embodying the invention with portions shown in cross-section.
FIG. 2 is a fragmentary cross-sectional view taken generally on section line 2—2 in FIG. 1.

The carburetor choke control embodying the invention is designated generally at 10 and is in the form of a combined automatic choke 12 and vacuum break device 14 both of which act to control the operation of the choke valve or plate 16 forming part of a carburetor 17. The plate 16 is mounted on a shaft 18 for rotation between open and closed positions in an air induction passage 20 of the carburetor 17.

Figure 3:
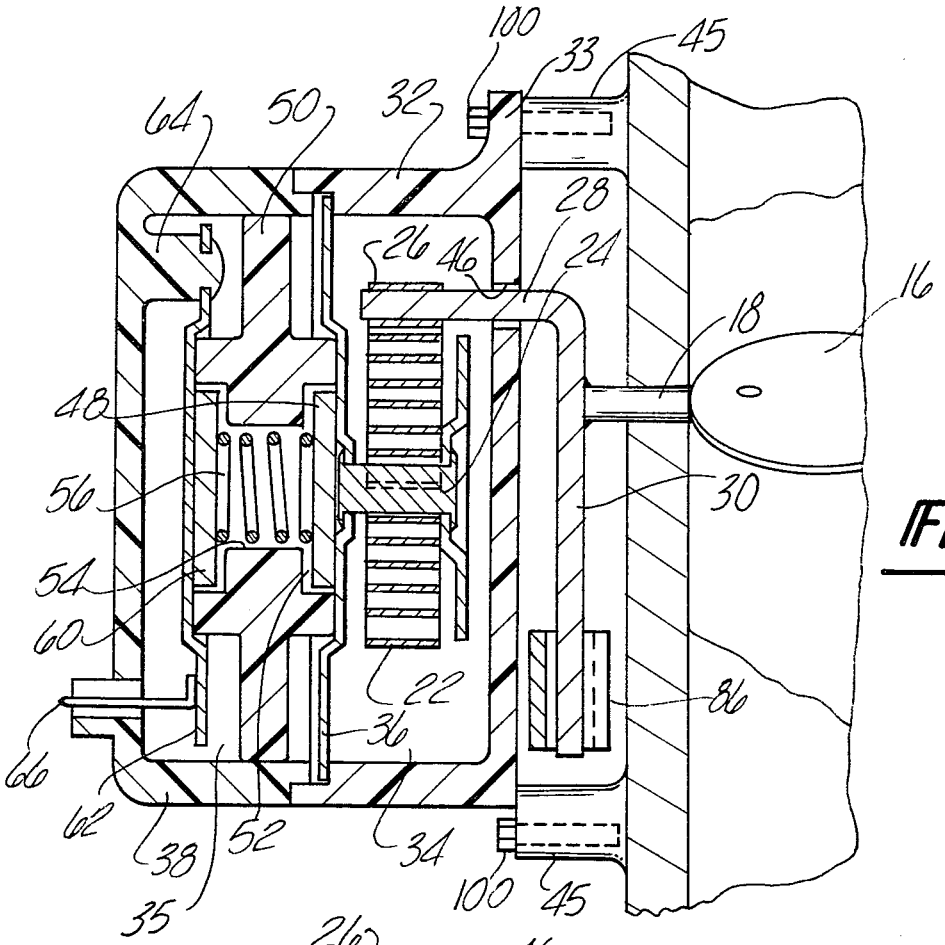
FIG. 3 is a cross-sectional view taken on line 3—3 in FIG. 1.
Figure 4:
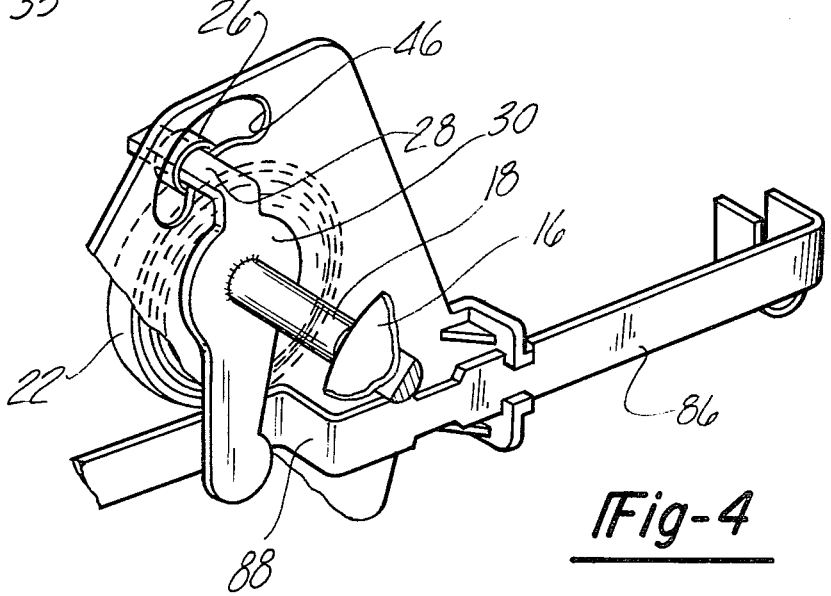
FIG. 4 is a schematic view showing the relationship of the control components relative to a choke valve.

The automatic choke 12 includes a temperature sensitive element in the form of a bimetallic coil 22 having its radially inner end fixed to a spindle 24 as seen in FIG. 3 while its radially outer end is connected by a loop 26 best seen in FIG. 4 to an arm 28 on a lever 30 connected to the choke plate shaft 18. The bimetal coil 22 is responsive to changes in temperature and tends to expand or contract to rotate the shaft 18 and to move the choke plate 16 to various positions in proportion to temperature. In a cold condition, the coil 22 is contracted and tends to move the choke plate 16 to its closed position as seen in FIG. 2. As the coil 22 is heated, it tends to expand and to rotate the shaft 18 and therefore the choke plate 16 toward an open position.

Bimetal coil 22 is disposed in a cylindrical housing 32 which is made of plastic material and is formed integrally with a bracket member 33. Housing 32 is divided into cavities 34 and 35 by a metal plate 36 which also supports the spindle 24. The metal plate 36 is held in position by a cap 38 forming part of housing 32 and also is made of plastic material and is fixed in position relative to the housing 32 by adhesive or sonic welding.

As seen in FIGS. 1 and 2, the plate 36 has an arm 40 protruding through a narrow slot 41 between the housing 32 and the cap 38. An arcuate slot 42 is formed in the arm to receive a screw 44 which passes through an opening in the bracket member 33 adjacent to the housing 32. The screw 44 is treaded into engagement with a complementary hole in one of several mounting pads 45 formed integrally with the carburetor housing. When the screw 44 is tight it acts to clamp the metal plate 36 in selected positions of rotation about the axis of the spindle 24. Rotation of the metal plate 36 makes it possible to adjust the bimetal coil 22 disposed in the cavity by coiling or uncoiling it to transmit motion and force by way of arm 28 protruding through an arcuate slot 46. The amount of bimetal force urging the choke plate 16 toward a closed position also determines the temperature at which the choke plate 16 begins to move from its closed position toward an open position.

The metal plate 36 supports heating means in the form of a positive temperature coefficient thermistor or PTC resistor 48. Such resistors can be in the form of chips of disc like form which are mounted on the metal plate 36 to be both electrically and thermally conductive with the plate 36.

Disposed in the cavity 35 formed within the cap 38 is an annular separator 50 of plastic material having a recess 52 receiving the disc shaped PTC resistor and a central opening 54 receiving an electrically conductive spring 56. One end of the spring 56 acts against the PTC unit 48 and the opposite end acts against a negative temperature coefficient thermistor or NTC resistor 60. The NTC unit 60 is fastened in electrically conductive relationship on a metal plate 62 which is riveted in position within the cap 38 on posts indicated at 64 in FIG. 2. The metal plate 62 is provided with an electrical terminal 66 adapted to be connected to a source of power such as a vehicle battery indicated diagrammatically at 68 in FIG. 2. A complete electrical circuit is formed from the battery 68 through a switch 69 such as the ignition switch of a vehicle, for example, and through the terminal 66 to the metal plate 62 and the NTC unit 60, through spring 56 to PTC element 48, plate 36, and screw 44 to ground at the carburetor housing. If desired, current may be supplied to the terminal 66 directly from an alternator driven by the engine instead of in response to closing of the ignition switch.

The NPC unit 60 is effective to sense engine or ambient air temperature to control current passing through the spring 56 to the PTC unit 48, the metal plate 36 and by way of the screw 44 to the ground formed by the carburetor 17 mounted on an internal combustion engine. The PTC unit 48 acts as a heater to heat the metal coil 22 in accordance with the temperature of the engine to regulate the degree of opening of the choke plate 16.

As seen in FIG. 1, the arm 40 is provided with index markings 70 adjacent to slot 42 which can be used as a reference for adjustment of the bimetal coil 22. Adjustment is made by retracting the screw 44 to allow rotation of the metal plate 36 to a selected position after which the screw 44 may be tightened to clamp the arm 40 in a selected position of adjustment. To make such adjustment the cap 38 remains stationary and does not disturb any electrical connections or the like made to the automatic choke 12.

The bracket 33 and housing 32 within which the automatic choke 12 is supported are made of plastic and are formed integrally with a vacuum break housing supporting the vacuum break mechanism 14.

The vacuum break housing 32 forms a cavity within which a diaphragm assembly 76 is mounted. The diaphragm assembly 76 divides the cavity into chambers 78 and 80. Chamber 78 is in continuous communication with the atmosphere and chamber 80 communicates by way of a stem 82 with a source of vacuum pressure such as the intake manifold 83 of an internal combustion engine. When an engine is started, vacuum created in the chamber 80 causes a differential pressure on the diaphragm assembly 76 causing it to move to the right as viewed in FIG. 1 against the biasing action spring 84 to move an output member or stem 86 to the right. As seen in FIGS. 2 and 4, the stem 86 is provided with an offset portion 88 which acts as a one-way connection to engage the lower end of lever 30 and rotate the shaft 18 in a direction opening the choke plate 16. The force of the vacuum break 14 is sufficient to overcome the force of the bimetal coil 22 so that even though the engine has not reached a sufficient temperature to heat the coil 22 to cause opening of the choke valve 16, the vacuum break 14 is effective to partially open the choke valve in response to starting of the engine.

The stem 86 of the vacuum break 14 has an end portion 90 which, as viewed in FIG. 1, is generally U-shaped and is adapted to engage an arm 92 after the stem 90 has moved some predetermined distance. Upon engagement with the arm 92 and continued movement of the stem 86, the arm 92 rotates a shaft 93 to move an air valve 94 found in some carburetors and indicated in FIG. 2 from a closed position toward an open position toward an open position.

The vacuum break 14 is provided with an adjusting screw 98 which determines the length of stroke of the stem 86 and the amount of opening of the choke valve 16. Typically this adjustment is made such that the choke valve 16 can be moved by the vacuum break to only a partly open position and the fully open position is brought about by the bimetal coil 22 after the engine has warmed up enough to activate the heater formed by the PTC unit 48.

The combined automatic choke and vacuum break device are formed in a single unitary housing structure which may be held in position on a carburetor 17 by means of screws 100 threaded into the carburetor body and makes it possible for both the automatic choke 12 and a vacuum break 14 to operate the choke valve 16 without a multiplicity of complex linkages and levers required by separate units.

A choke control mechanism in the form of a combined automatic choke and vacuum break device are disposed in a single unitary housing structure in separate cavities which are permanently sealed. The bimetal unit is mounted on a metal plate which may be rotated from the exterior of the housing to selected positions of adjustment determining the closing force of the choke plate of a carburetor with the adjusting means also forming part of the circuit from electric heating means within the automatic choke housing. The vacuum break device also has means for adjusting the length of stroke from the exterior of the sealed housing.

The embodiments of the invention in which an exclusive property or privilege is claimed are defined as follows:

1. A choke control mechanism for regulating the choke of a carburetor on an internal combustion engine comprising; a housing formed of plastic material and forming adjacent closed cavities in said housing, a bimetal coil in one of said cavities having one end connected to said choke and the other end connected to a metal plate member, said plate member being disposed in said housing for limited rotation to coil or uncoil said bimetal coil, an arm connected to said plate member and protruding from said cavity to the exterior of said housing for rotating said plate member to selected positions while said housing remains stationary, an electric heating element within said housing and positioned on said metal plate member adjacent to said bimetal coil, circuit means connected to said heater means for heating the latter, said circuit means including one terminal in fixed position on the exterior of said housing during rotation of said plate relative to said housing and electrically connected to said metal plate member, a fastening means forming part of said circuit means for releasably holding said arm in selected positions and grounding said plate member electrically to said carburetor, said bimetal coil being operative to urge said choke to a closed position when the engine is relatively cold and not operating with a force inversely proportional to engine temperature and to urge said choke to an open position in response to heat from said engine and from said heating element, a diaphragm supported in the other of said cavities and responsive to a source of vacuum created when said engine is operating to move said choke valve from said closed position to a partially open position in opposition to the closing force of said bimetal coil.

2. A choke control mechanism for regulating the choke of a carburetor on an internal combustion engine comprising; a housing formed of plastic material and adapted to be supported on said carburetor, a bimetal coil in said housing having one end connected to said choke and the other end connected to a metal plate member, said plate member being disposed in said housing for limited rotation to coil or uncoil said bimetal coil, an arm formed on said plate member to extend radially therefrom and protrude from said housing for rotating said plate member to selected positions while said housing remains stationary, an electric heating element disposed within said housing adjacent to said bimetal coil and electrically connected to said plate member, circuit means connected to said heater means for heating the latter, said circuit means including a terminal disposed in fixed position on the exterior of said housing during rotation of said plate member relative to said housing and being electrically connected to said metal plate member, fastening means for releasably holding said arm in selected positions, said fastening means being connected to said carburetor and forming part of said circuit between said plate member and said carburetor, said bimetal coil being operative to urge said choke to a closed position when the engine is relatively cold and not operating with a force inversely proportional to engine temperature and to urge said choke to an open position in response to heat from said engine and from said heating element.

3. The combination of claim 2 wherein said electric heating element is a PTC unit.

4. The combination of claim 2 and further comprising an NTC unit connected in series with said PTC unit.

5. The combination of claim 2 wherein circuit means between said NTC unit and PTC unit is formed by an electrically conductive spring.

6. The choke control mechanism in claim 2 and forming a second housing unitary with said first named housing, a diaphragm supported in said second housing and being responsive to a source of vacuum created when said engine is operating to move said choke valve from said closed position to a partially open position in opposition to the closing force of said bimetal coil.

7. The choke control mechanism in claim 2 wherein said heater element is supported on said plate in electrically conductive relation thereto.

* * * * *